United States Patent [19]

Parsons

[11] 3,959,832

[45] June 1, 1976

[54] INVALID HAMMOCK

[76] Inventor: Vivian Parsons, Rte. No. 2, Box 277B, Shelbyville, Tenn. 37160

[22] Filed: June 25, 1974

[21] Appl. No.: 482,876

[52] U.S. Cl. ..... 5/84; 5/81 R; 5/86

[51] Int. Cl.[2] ..... A47B 83/04 A61G/1/02;

[58] Field of Search ..... 5/61, 81, 5/83–89, 123, 124, 127, 317; 128/1 R, 13 R, 134

[56] References Cited

UNITED STATES PATENTS

| | | | |
|---|---|---|---|
| 962,380 | 6/1910 | McMahan | 5/84 |
| 1,917,518 | 7/1933 | Goudie | 5/123 |
| 1,977,944 | 10/1934 | Haskett | 5/84 |
| 3,449,776 | 6/1969 | Brock | 5/82 |
| 3,451,071 | 6/1969 | Whiteley | 5/91 |
| 3,562,824 | 2/1971 | White | 5/61 |
| 3,626,526 | 6/1969 | Viel | 5/91 |
| 3,671,983 | 6/1972 | Bertolet | 5/82 |
| 3,737,923 | 6/1973 | Prolo | 5/92 |

*Primary Examiner*—Casmir A. Nunberg
*Attorney, Agent, or Firm*—Abe Hatcher

[57] ABSTRACT

A hammock having closeable openings therein adapted to fit against pressure points on an individual when lying thereon.

14 Claims, 4 Drawing Figures

INVALID HAMMOCK

BACKGROUND OF THE INVENTION

1. Field of the Invention

This invention relates to treatment of decubitis. More particularly, it relates to an adjustable hammock having closeable openings therein adapted to fit against pressure points on a person lying thereon.

2. Description of the Prior Art

There is presently no known 100% effective preventive or cure for decubitis, which is the medical name for the bed sores often encountered in hospital or nursing home patients at primary pressure points on their bodies, particularly after lying in the same position for prolonged periods. Chemical remedies have been deficient in that they do not prevent close contact of the infected contact points with covers such as bed sheets or with mattresses. Foam rubber, foam chemical or padded mattresses, mattress covers or mats have met with only limited success in avoiding or helping to get rid of bed sores because of indirect limited contact with hard surfaces remaining at these pressure points. Therefore, providing a device which minimizes decubitis or can be used to help cure it if detected early enough as a result of close watch represents a highly desirable result. After extended investigation I have found just such a device.

SUMMARY OF THE INVENTION

In its broader aspects my invention involves provision of a plurality of openings in a hammock for projection therethrough of the pressure points on a patient's body. This prevents harmful contact with any surface which might be prolonged contact or rubbing cause decubitis or bed sores. My hammock may be made of any conventional material, for example, canvas, vinyl, or the like, sufficiently flexible to be comfortable to a person lying thereon. For additional comfort the hammock may be provided with a cushion surface such as foam rubber or foam chemical, for example, polystyrene or polyurethane, on the side thereof on which the patient is to lie. According to my invention, openings are provided at points of pressure on the body that are prone to breaking down, for example, at the approximate location of the shoulder blades, hip bones, end of spine, heels and the like. While speaking in terms of points which receive pressure while a person normally lies on his or her back, the openings according to my invention are so located that, when the person lies on either side, openings would be available at the points at which the most pressure would be exerted. I provide flaps which could be zipped or tied or otherwise held in open and closed positions, depending upon which one or more pressure points a patient might be experiencing difficulty with. If a patient is lying on his side, for example, an additional centrally located hip-bone pressure flap could be left open for use. The flaps may be left open all the time to avoid development of bed sores at pressure points altogether.

While the hammock of my invention can be used conveniently to carry the patient from a scene of an accident or an operation to a hospital bed or simply for lifting a person from a roller-type transporting bed into a hospital bed, it can be even more conveniently used in conjunction with a hospital or nursing home bed in which the patient would ordinarily be kept. Thus, the patient could be kept permanently on the hammock elevated sufficiently above the mattress to prevent contact therewith of any of the parts of his body projecting through the holes in the hammock. By using my hammock in this manner, bed sores are prevented because the pressure points of the person's body do not touch the mattress at all, but the bed is still there to prevent injury in case the hammock should slip down. Furthermore, the hammock can be lowered to the bed when bathing or other treatment of a sick person is required.

The manner in which my hammock is attached to a bed or to adjustable rods or stands or like objects is not critical, provided the objects to which the ends of the hammock are attached have an appropriate device in association therewith for raising and lowering the hammock. For example, an hydraulic lift-type device is appropriate, or simply an adjustable rod, handle-type device similar to that conventionally used to raise or lower both ends of most hospital beds.

My hammock may be provided appropriately with one or more straps on the order of seat belts to prevent a patient from falling out. These are also useful in holding down and preventing injury to excitable patients. According to another embodiment of my invention, the hammock may be provided with a mid-section or strip, preferably substantially rectangular in shape, which is adjustable, preferably by means of straps joining halves of the hammock. Thus, the hammock can be adjusted in length to fit either short or tall people. The adjustable straps, in addition to improving strength, also may be used to provide the plurality of openings in the hammock according to the invention. According to a still further embodiment, the hammock of my invention may be made up of several sections or strips connected by such straps or simply of a plurality of longitudinal and transverse straps in a criss-cross pattern such that the required openings for pressure points are provided. Further according to my invention, the openings may be provided with canvas or vinyl flaps or the like. These can be folded back and snapped when the openings are being used.

Additional features of the invention include the provision of sufficient openings for wounds on various parts of the body to be treated from underneath when the hammock is in a raised position, and the possibility of either making the hammock out of foam rubber or foam chemical or providing a foam rubber or foam chemical padding or cover over a canvas or other type flexible substrate for the added comfort of a patient lying thereon. Also, for further comfort, a nurse or attendant can give the hammock at least a slight swing to provide a soothing effect or increase circulation in a patient.

BRIEF DESCRIPTION OF THE DRAWING AND DESCRIPTION OF THE PREFERRED EMBODIMENT

For a better understanding of my invention, reference will now be made to the drawing, which is illustrative of the hammock of the invention as used in conjunction with a bed.

Figure 1:
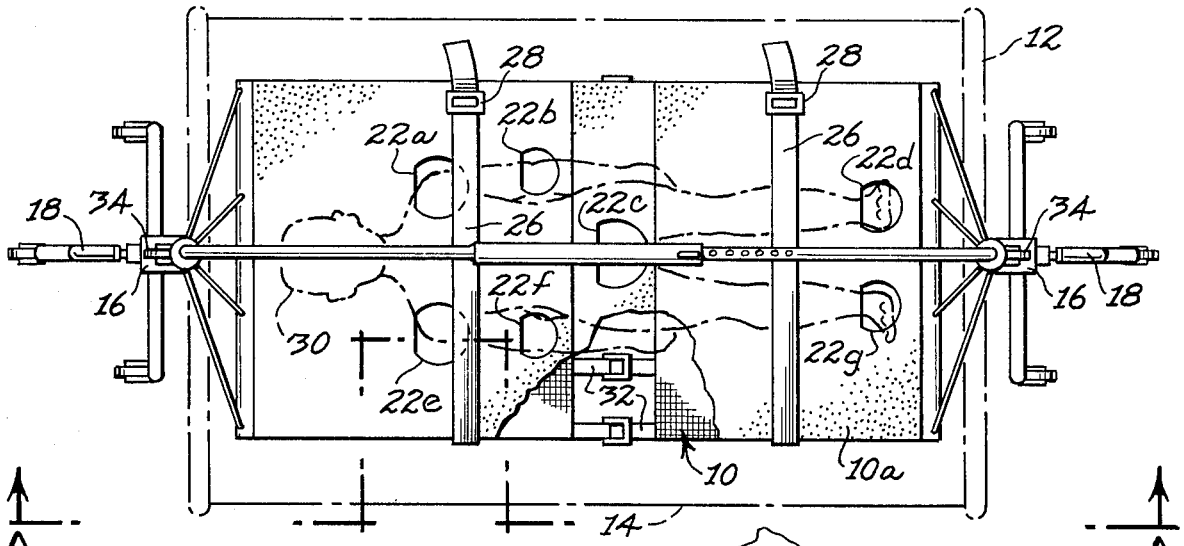
FIG. 1 is a sectional view from above of a hammock according to the invention, showing a patient lying therein.
Figure 4:
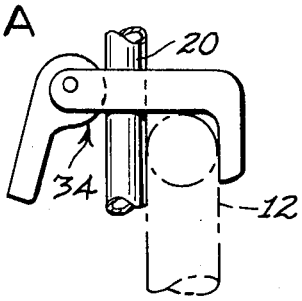
FIG. 4 is an enlarged view of a representative mechanism by which the frame or stanchion to which the hammock is joined may be secured or attached to the head and foot of a bed above which the hammock may be suspended.
Figure 3:
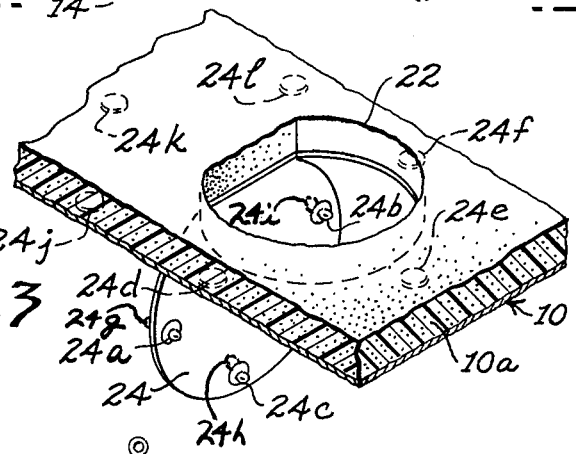
FIG. 3 is an enlarged view of one of the pressure point openings in the hammock of the invention including a closeable flap.
Figure 2:
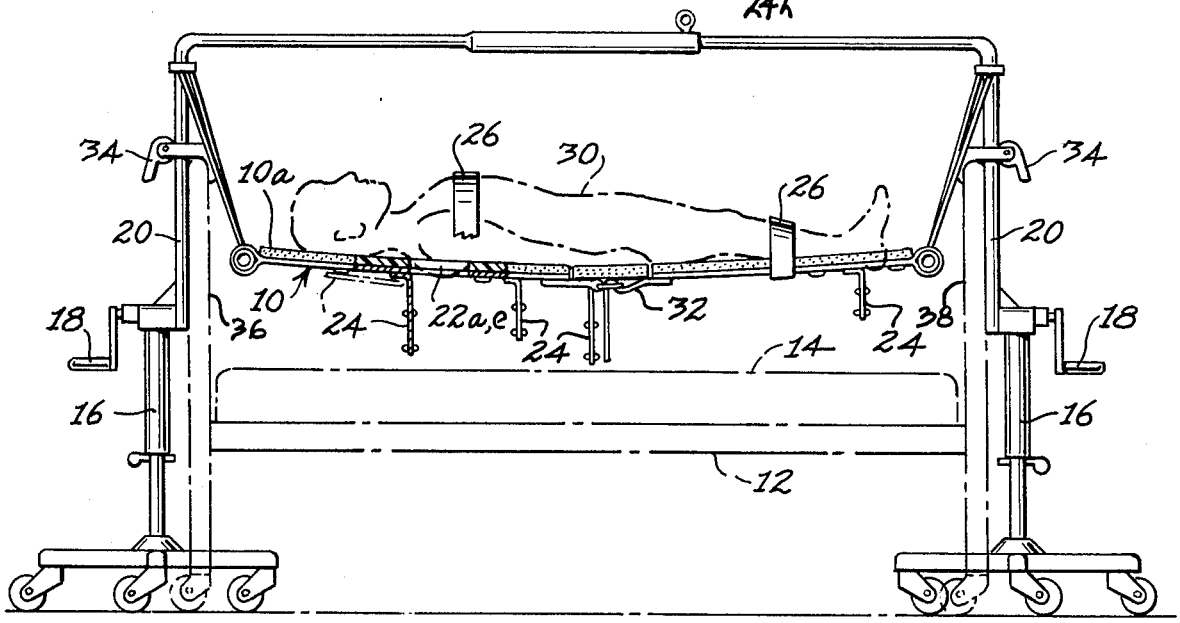
FIG. 2 is a side view taken at A—A of FIG. 1.

A hammock 10 having a cushion foam rubber or foam chemical surface 10*a*, such as polystyrene or polyurethane, is shown suspended above bed 12 which has a mattress 14 thereon. An hydraulic or other-type adjustable lift 16 is shown at each end of the bed. Handles 18 are provided for raising or lowering adjustable rods 20. A plurality of pressure point openings 22*a*, 22*b*, 22*c*, 22*d*, 22*e*, 22*f*, and 22*g* in hammock 10 with flaps 24 therefor, are shown in opened form in FIG. 3, with tabs 24*a*, 24*b*, and 24*c* for buckling closed at 24*d*, 24*e*, and 24*f* and tabs 24*g*, 24*h*, and 24*i* for buckling open at 24*j*, 24*k*, and 24*l*. Safety belts 26 having buckles 28 may also be provided for strapping patient 30 in the hammock. In the illustrated embodiment flexible or buckle-type straps 32 are provided to hold two halves of the hammock together and permit extension for taller patients. A roller-type disengagement device 34 shown in enlarged form in FIG. 4 is provided for attaching the vertical rod portions of the hammock holder or suspension member to the head 36 and foot 38 of bed 12.

While the invention has been described in terms of preferred embodiments, the claims appended hereto are intended to encompass all embodiments which fall within the spirit of the invention.

Having thus described my invention and certain preferred embodiments thereof, I claim:

1. A bed for an invalid comprising a hammock suspended above the mattress of a bed, said hammock having a plurality of openings therein, said openings being positioned in the vicinity of contact points for shoulder blades, hip bones, end of spine and heels of a patient lying therein, said hammock being joined at each end thereof to adjustable members whereby said hammock may be raised and lowered, said hammock being adjustable to fit patients of different sizes.

2. The device of claim 1 wherein the hammock has a main section for holding a person's body, said main section being adapted at each end thereof for securing in position.

3. The device of claim 2 wherein said main section is made of canvas or vinyl.

4. The device of claim 2 wherein said main section is substantially rectangular in shape.

5. The device of claim 2 wherein said main section has one or more ropelike extensions at each end thereof adapted to join each end to at least one fixed point.

6. The device of claim 2 having adjustable belts joining the two sides of said main section, said belts adapted to hold a patient in place on said hammock.

7. The device of claim 2 wherein said main section is divided into two halves joined together by one or more extendible straps.

8. The device of claim 2 wherein the openings have flaps adapted to cover same and to be buckled back in open position.

9. The device of claim 8 wherein the flaps have at least one tab on each side thereof adapted to be buckled in open and closed position to holders therefor provided on the underside of the hammock.

10. The bed of claim 1 wherein the members are joined to the bed.

11. The bed of claim 1 wherein the members have handles adapted to raiser and lower the hammock.

12. The bed of claim 1 wherein the members comprise hydraulic lifts.

13. The bed of claim 1 wherein the hammock has a cushion layer on the top surface thereof.

14. The bed of claim 13 wherein the cushion layer comprises foam rubber or foam chemical.

* * * * *